US007941085B2

(12) United States Patent
Duda et al.

(10) Patent No.: US 7,941,085 B2
(45) Date of Patent: May 10, 2011

(54) FUSING CORE AND DRIVE COLLAR ASSEMBLY

(75) Inventors: Richard M Duda, Stillwater, MN (US); Wade R Eichhorn, Minneapolis, MN (US); Kristian G Wyrobek, Minneapolis, MN (US)

(73) Assignee: 7-Sigma, Inc., Minneapolis, MN (US)

( * ) Notice: Subject to any disclaimer, the term of this patent is extended or adjusted under 35 U.S.C. 154(b) by 6 days.

(21) Appl. No.: 12/544,827

(22) Filed: Aug. 20, 2009

(65) Prior Publication Data

US 2011/0044738 A1 Feb. 24, 2011

(51) Int. Cl.
*G03G 15/20* (2006.01)

(52) U.S. Cl. ..... 399/333; 219/216; 399/330

(58) Field of Classification Search ..... 399/333, 399/330, 328; 219/216, 469; 492/46, 47
See application file for complete search history.

(56) References Cited

U.S. PATENT DOCUMENTS

| | | | | |
|---|---|---|---|---|
| 4,229,950 | A | 10/1980 | Fessenden | |
| 4,952,782 | A | 8/1990 | Yokokawa et al. | |
| 5,070,373 | A * | 12/1991 | Fukano et al. | 219/216 X |
| 5,649,891 | A | 7/1997 | Kass et al. | |
| 5,659,848 | A | 8/1997 | Jeon | |
| 6,363,613 | B1 | 4/2002 | Wolf et al. | |
| 6,440,048 | B1 | 8/2002 | Bleil et al. | |
| 6,665,504 | B2 | 12/2003 | Lee et al. | |
| 7,242,899 | B2 | 7/2007 | Eichhorn et al. | |
| 2005/0045666 | A1 * | 3/2005 | Kasting | 222/482 |
| 2007/0009292 | A1 * | 1/2007 | Kim et al. | 399/333 |

* cited by examiner

*Primary Examiner* — Sophia S Chen
(74) *Attorney, Agent, or Firm* — Patterson Thuente Christensen Pedersen, P.A.

(57) ABSTRACT

A system for stabilizing a fuser core in an imaging device. The system includes a fuser core having a body and two opposing ends, and a pair of hubs. The opposing ends of the fuser core are configured with ratchet type geometric profiles that mate with ratchet type geometric profiles configured on the corresponding hubs. The system also includes two elastomeric collars each of which is at least partially disposed between the end of the fuser core and the corresponding mating hub.

8 Claims, 11 Drawing Sheets

FUSING CORE AND DRIVE COLLAR ASSEMBLY

FIELD OF THE INVENTION

The present invention generally relates to products and methods for fusing toner to print media. More particularly, the invention relates to a self locking drive mechanism apparatus for minimizing the wear on the core and hub assembly and minimizing the gap caused by thermal expansion of the fusing system members at operating temperature.

BACKGROUND OF THE INVENTION

Laser printers and other electrophotographic image forming devices use toner particles to form a desired image on print media. The print media is often paper, although a wide variety of different print media may be employed. Once the toner is applied to the media, the media is advanced along a media path to a thermal fuser. In some image forming devices, the fuser includes a fuser roller and a mating pressure roller. As the media passes between the fuser roller and the pressure roller, the toner is fused to the media through a process using pressure and heat exceeding 300.degree. F. (148.degree. C.).

The interference area between the fuser roller and the pressure roller is often referred to as the nip. It is desirable to maintain a substantially uniform pressure in the nip. Uneven or non-uniform pressure may result in degraded print quality, wrinkled print media, or other undesirable consequences. As a result, the various fusing assembly components should preferably be mated to close tolerances at room temperature and remain close at operating temperature so that wobble and chattering are minimized.

Electrophotographic image forming devices, such as high speed laser printers, may utilize a fusing system consisting of a fuser roller and associated drive mechanism which may employ a coupled drive hub assembly. The fuser roller typically includes a metal core made of aluminum. The mating fusing assembly includes a hub and collar. The fusing assembly components are commonly fabricated of a steel alloy and may also include drive members such as a steel key. The fusing assembly components may also include an elastomeric collar for minimizing the gap caused by thermal expansion of the fusing system members at operating temperatures, as discussed in U.S. Pat. No. 7,242,899, incorporated herein by reference.

The fuser roller and drive hub assembly rotate at high speed in a single rotational direction. As the imaging device rotates at operating revolutions, instabilities are created by extremely fast stop/start conditions, causing micro machining issues between the contacting surfaces, which eventually develop failure modes of the apparatus. For example, as the imaging device heats from ambient temperature to operating temperatures exceeding 300.degree. F. (148.degree. C.), the components of the fusing assembly expand in relation to their respective coefficients of thermal expansion. The thermal expansion of the aluminum roller core is larger than the thermal expansion of the steel hub components. The thermal expansion of the plastic collar is significantly less than the thermal expansion of both the aluminum roller core and the steel hub components.

The differences in thermal expansion between the various components adversely affects the mechanical stability and operating life of the fuser components. As the imaging device heats to operating temperature, the inside diameter of the fuser roller becomes greater than the outside diameter of the mating components. As a result, a minute level of wobble and chatter can be observed as the fuser roller rotates. The instability of the fuser roller at operating speed and temperature can cause micro machining of the steel hub assembly, plastic collar, and the surfaces of the fuser roller core. Eventually, the instability caused by the gap between the fusing members at operating temperatures may cause catastrophic failure of the fuser roller, plastic collar, or hub assembly. Therefore, a system and method for addressing these and other related problems is desirable.

SUMMARY OF THE INVENTION

The invention includes an apparatus for the fuser assembly of an imaging apparatus. The apparatus includes a hub having a body, wherein the body includes an outside diameter configured with an exterior ratchet type design geometry surface profile to be at least partially disposed inside an end of a fuser core with a mating interior ratchet type design geometry surface profile. The inventions also includes a hub with an exterior ratchet type design geometry surface profile disposed inside a fuser core with a mating interior ratchet type design geometry surface profile forming a self locking drive mechanism upon rotation of one or both members in a single described direction of fuser roller rotation. The invention further includes a hub with an exterior ratchet type design geometry surface profile wherein an elastomeric collar having an inside diameter is at least partially disposed over the outside diameter of the hub.

In a further embodiment, the invention includes an apparatus for a fuser assembly in an imaging apparatus, including a fuser core having a body, wherein the body comprises an outside diameter configured with an exterior ratchet type design geometry surface profile to be at least partially disposed inside an inner diameter of a hub with a mating interior ratchet type design geometry surface profile, and a fuser core with an exterior ratchet type design geometry surface profile disposed inside a hub with a mating interior ratchet type design geometry surface forming a self locking drive mechanism upon rotation of one or both coupled members in a single described direction of fuser roller rotation, and a fuser core with an exterior ratchet type design geometry surface profile wherein an elastomeric collar having an inside diameter is at least partially disposed over the outside diameter of the core. The ratchet type geometric design surface profile on each of the corresponding hub and core components, is defined by at least two opposite circular arcs, 180 degrees apart, whereas a circle is defined as a subset of an ellipse. Furthermore the arcs are defined by a curve which is a portion of a circle whereby the center of the circle is offset from a minor diameter circle. Each opposing arc is a portion of a circle whereby the center of the circle is offset an equal but opposite distance along a straight line from the center of the minor circle. The distance from the center of the minor circle defines the height or depth of the arc, depending upon if the arcs are inscribed on an exterior or interior surface.

In another embodiment, the ratchet type geometric design surface profile on each of the corresponding hub and core components, forming a mating surface, is comprised by an integral number of circular arcs, greater than 2, (3, 4, 5 and so forth). The corresponding opposing curves will be offset, in degrees, around the minor circle, by divisive integral multiples, generated by 360 degrees divided by the number of arcs to be used.

In yet another embodiment, the ratchet type geometric design surface profile on each of the corresponding hub and core mating components, comprise a self locking drive mechanism upon rotation of one or both coupled members in a single direction. An elastomeric collar may be applied to the exterior or interior surfaces of either the hub or the fuser core surfaces or both. Furthermore the collar is fabricated from an elastomeric material selected from the group consisting of thermosetting elastomers, thermoplastic elastomers, polymer alloys, blends or hybrid materials capable of continuous operation at temperatures up to 482° F. (250° C.) as described in U.S. Pat. No. 7,242,899.

The objective of the present invention is to provide an apparatus to further reduce the fuser roll hub/collar assembly wear when maintained at operating speed and temperature.

Another objective of the present invention is to provide an apparatus which further reduces instability of the fuser roll and hub/collar assembly at its operating speed and temperature as well as sudden start and stop operations.

Another objective of the present invention is to provide an apparatus which compensates for the differences in the thermal expansion between different materials from which the fusing members are composed as covered by U.S. Pat. No. 7,242,899.

Yet another objective of the present invention is to further reduce the micro machining wear issues between contacting surfaces.

Another objective of the present invention is to provide an apparatus which eliminates the need for a drive member such as a steel key and associated drive slots.

Another objective of the present invention is to provide an apparatus in which a self-locking drive mechanism eliminates the need for a drive member such as a steel key and associated drive slots.

The invention comprises a hub having a body. The body comprises an outside diameter configured to be at least partially disposed inside an end of a fuser core. The apparatus also includes an exterior ratchet type design geometric surface profile which mates with a corresponding interior ratchet design geometric surface profile, forming a self-locking drive mechanism. The apparatus also includes an elastomeric collar having an inside diameter, wherein the inside diameter is at least partially disposed over the outside diameter of the hub.

In another embodiment, the fusing apparatus includes a fuser roller having a first end, a second end, and an elongated shaft extending from the first end to the second end. The first end defines a first inner diameter and the second end defines a second inner diameter. The inner diameter of the first end and/or the inner diameter of the second end are composed of a ratchet type design surface geometry. A first hub is at least partially disposed on the first inner diameter of the first end. A second hub is at least partially disposed on the second inner diameter of the second end. The exterior diameter of the first hub and/or the second hub, are composed of a ratchet type design surface geometry. The ratchet type design surface geometry may be machined onto or into the surface, or may be an attachment applied to either of the surfaces.

In another embodiment, the fusing apparatus includes a fuser roller having a first end, a second end, and an elongated shaft extending from the first end to the second end. The first end defines a first exterior diameter and the second end defines a second exterior diameter. The exterior diameter of the first end and/or the exterior diameter of the second end are composed of a ratchet type design surface geometry. A first hub inner diameter is at least partially disposed on the exterior diameter of the first end of the fuser roller. A second hub inner diameter is at least partially disposed on the exterior diameter of the second end of the fuser roller. The interior diameter of the first hub, and/or the second hub, are composed of a ratchet type design geometric surface profile.

In yet another embodiment, the invention includes an elastomeric sleeve applied to a portion of the exterior ratchet design surface of the hub. The invention may also include an elastomeric sleeve applied to a portion of the interior ratchet design surface of the fuser roller ends, or any combination thereof.

In yet another embodiment, the invention includes an elastomeric sleeve applied to a portion of the interior ratchet design surface of the hub. The invention may also include an elastomeric sleeve applied to a portion of the exterior ratchet type design geometric surface profile of the fuser roller ends, or any combination thereof.

The fusing system assembly apparatus is comprised of a self-locking ratchet type geometric design mechanism in which an exterior ratchet type design surface is imposed into a mating interior ratchet type design surface. The ratchet type design mating surfaces form a locking mechanism when rotation in a single direction is applied by either member. The locking mechanism results from the increase in pressure on the mating surfaces as rotation in a single direction is employed. The design of the mating surface geometry is such that locking occurs in one direction, unlocking occurs in the opposite direction.

The embodiment of the ratchet type geometric design self locking drive mechanism is defined by at least two opposite circular arcs, 180 degrees apart, whereas a circle is defined as a subset of an ellipse. The arcs are defined by a curve which is a portion of a circle whereby the center of the circle is offset from a minor diameter circle. Each opposing arc is a portion of a circle whereby the center of the circle is offset equal but opposite distance along a straight line from the center of the minor circle. The distance from the center of the minor circle defines the height or depth of the arc, depending upon if the arcs are inscribed on an exterior or interior surface.

Yet a further embodiment of the ratchet type geometric design self locking drive mechanism may also be defined by an integral number of arcs, 2, 3, 4, and so forth. The corresponding opposing curves will be offset, in degrees, around the minor circle by divisive multiples, generated by 360 degrees divided by the number of arcs to be used.

DETAIL DESCRIPTION OF THE INVENTION

Figure 1:
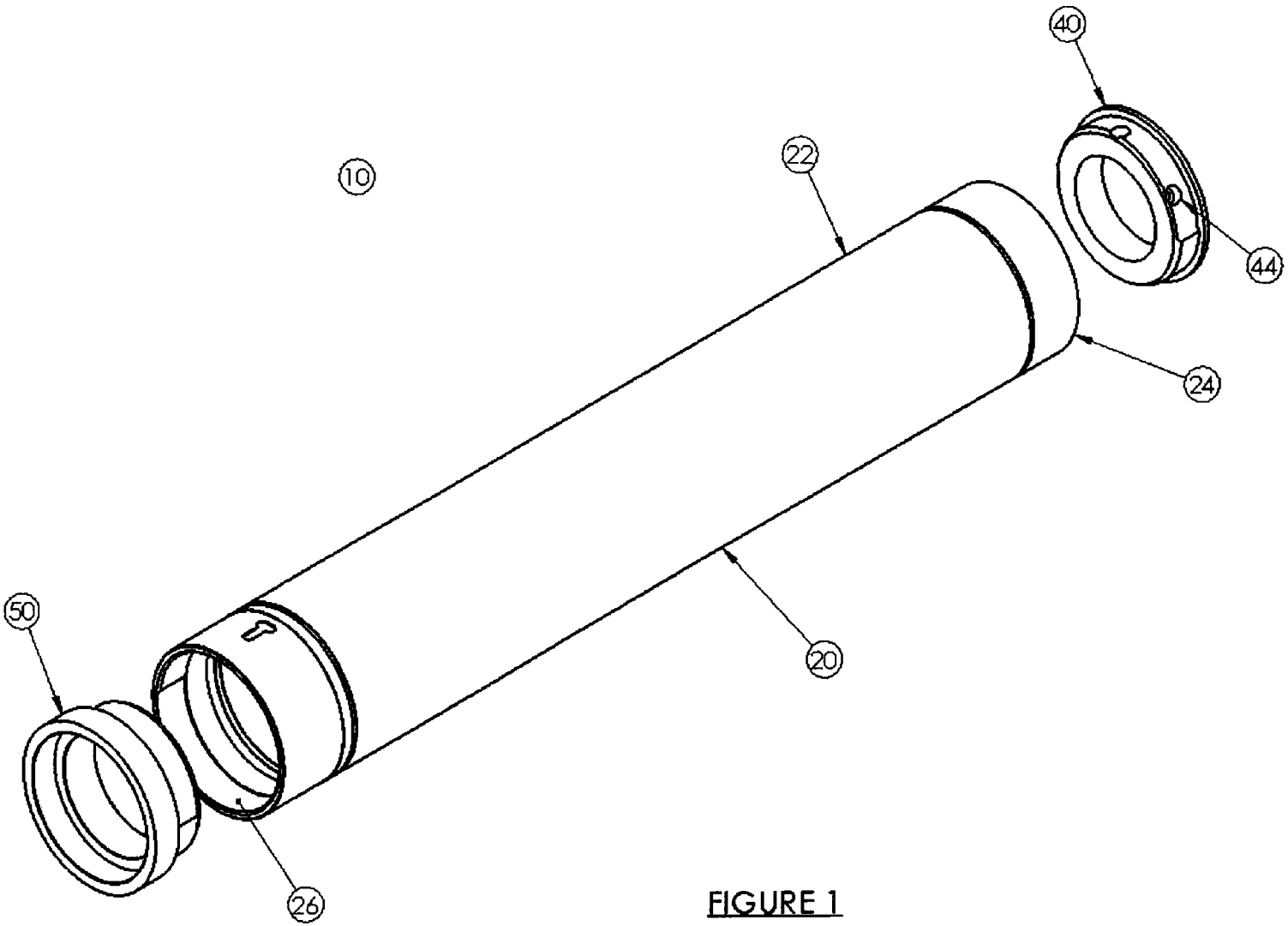
FIG. 1 shows an expanded isometric view of the fuser assembly in accordance with the present invention.
Figure 2:
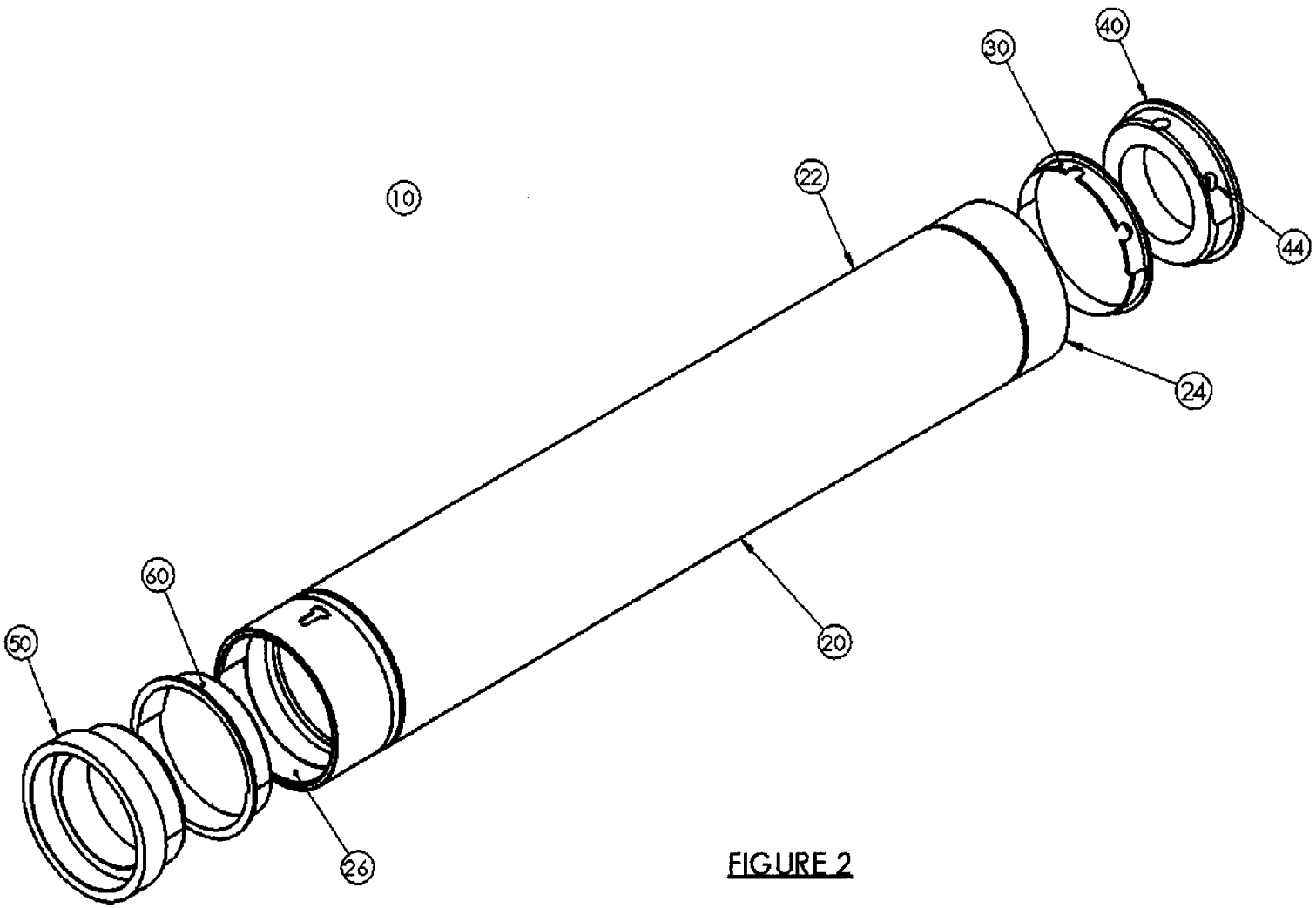
FIG. 2 shows an expanded isometric view of the fuser assembly in accordance with the present invention.

With reference to FIGS. 1-2, a fuser assembly 10 of the present invent is shown. Assembly 10 includes a fuser core 20, a first collar 30, a first hub 40, a second collar 60, and a second hub 50. Fuser core 20 defines an elongated shaft 22 terminating at a first end 24 and a second end 26. Fuser core 20 is typically fabricated from aluminum or another material suitable for transferring heat.

Figure 3:
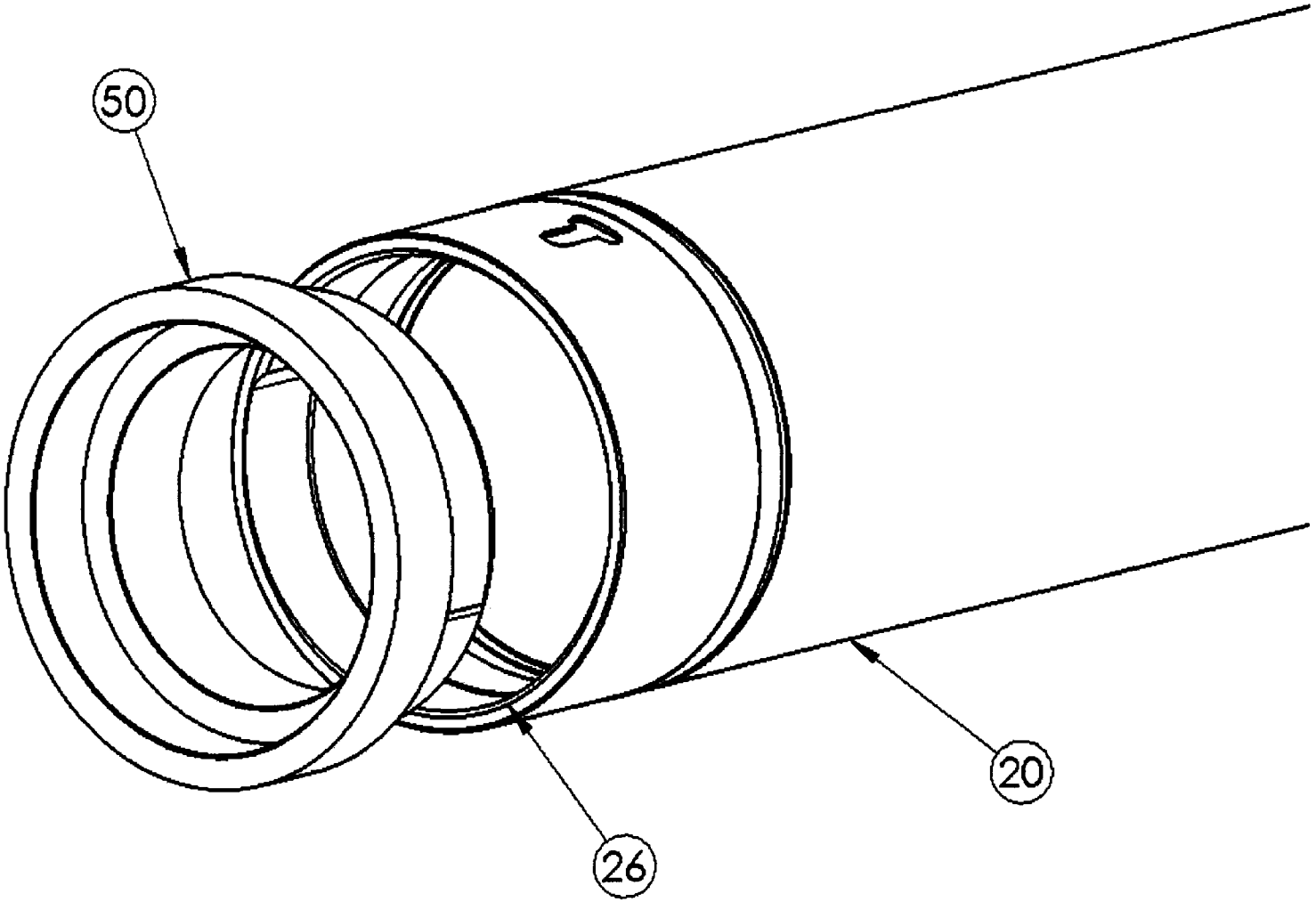
FIG. 3 shows a partial expanded isometric view of a hub and core end assembly in accordance with the present invention.
Figure 4:
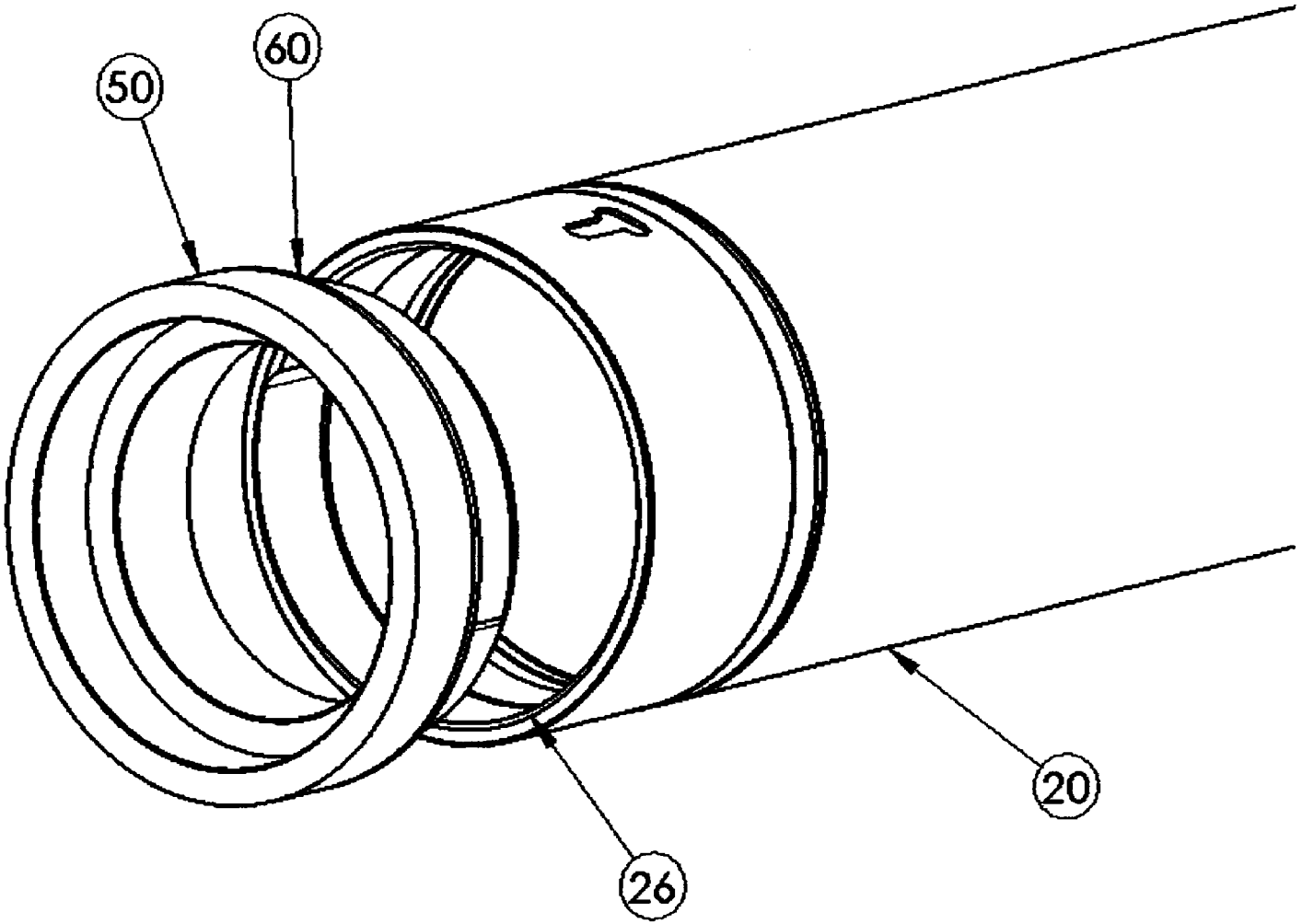
FIG. 4 shows a partial expanded isometric view of a hub and core end assembly with an elastomeric collar in accordance with the present invention.

Fuser core 20 mates with hub 40 at end 24 and hub 50 at end 26, respectively, to facilitate rotation of core 20. The specific configuration of hub 40, hub 50 and core 20 will vary depending upon the specific printer or copier in which it is used. Hub 40 may also include aperture 44 to mount hub 40 to an electrophotographic printer or copier. Hub 50 is shown having an exterior ratchet type geometric surface profile with two arcs. Core end 26 is show having a mating interior ratchet type geometric surface profile with two arcs. FIG. 3 shows an expanded isometric view of core 20 with an end 26 having an interior ratchet type geometric surface profile and hub 50 having a mating exterior ratchet type geometric surface profile. Furthermore, FIG. 4 shows an expanded isometric view of core 20 with an end 26 having an interior ratchet type geometric surface profile and hub 50 having an exterior ratchet type geometric surface profile and an elastomeric collar 60. In a preferred embodiment of the present invention, hub 50 having an exterior ratchet type geometric surface profile is inserted into core end 26 having a corresponding mating interior ratchet type geometric surface profile to the exterior ratchet type geometric surface profile of hub 50. Correspondingly hub 40 having an exterior ratchet type geometric surface profile is inserted into mating fuser core end 24 having an interior ratchet type design geometric profile. Hub 50 is slidably and rotatably inserted into the receiving end of core 20 until the ratchet-type geometric profile integral to the outside diameter of hub 50 fully engages the mating ratchet-type geometric profile integral to inside circumference of the cavity at the end of core 20. The ratchet configuration creates a rigid, captive and secure mechanical tightening of hub 50 onto core 20. With the rotation of hub 50 and or core 20, the mechanism will further tighten creating the drive mechanism described above in the preferred rotational direction of the fuser roller. Furthermore, the addition of an elastomeric collar as shown in FIGS. 2, 4, 6 and 11, will provide improved contact and stability at elevated operational temperatures of the fusing system as described in U.S. Pat. No. 7,242,899.

Figure 5:
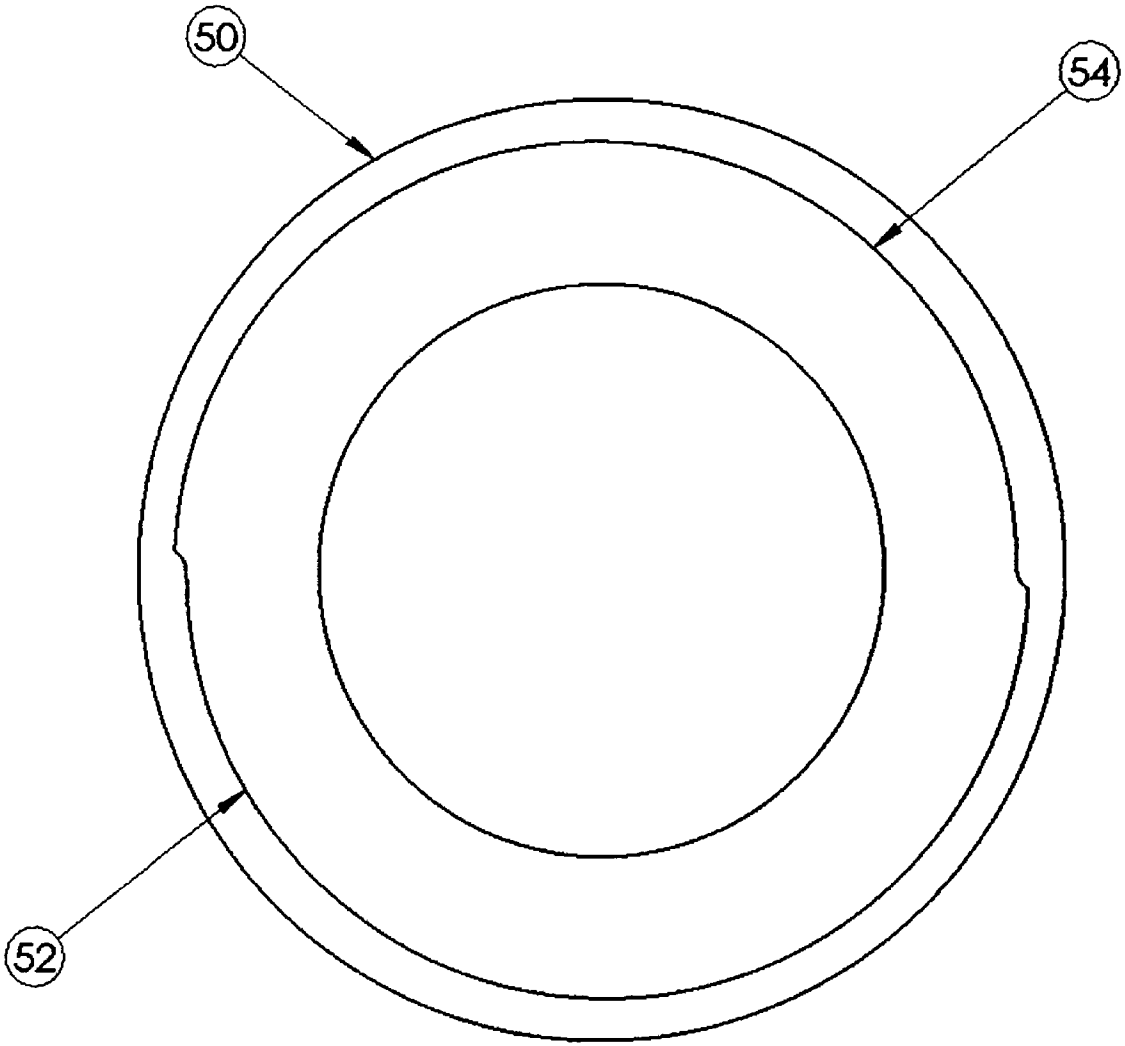
FIG. 5 shows an expanded view of a hub with an exterior ratchet type geometric surface profile with two arcs in accordance with the present invention.
Figure 6:
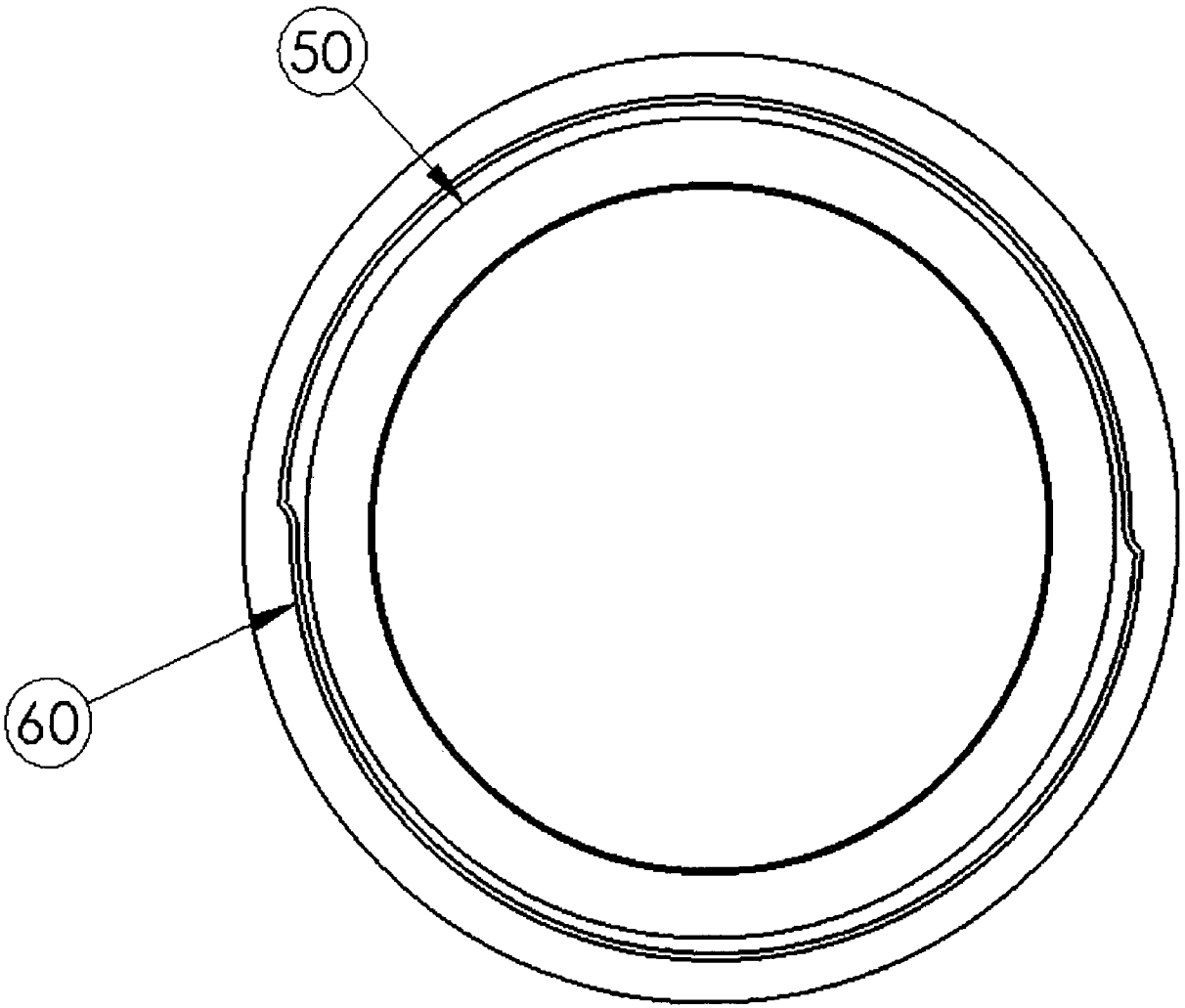
FIG. 6 shows an expanded view of a hub with an exterior ratchet type geometric surface profile with two arcs and an elastomeric collar in accordance with the present invention.
Figure 7:
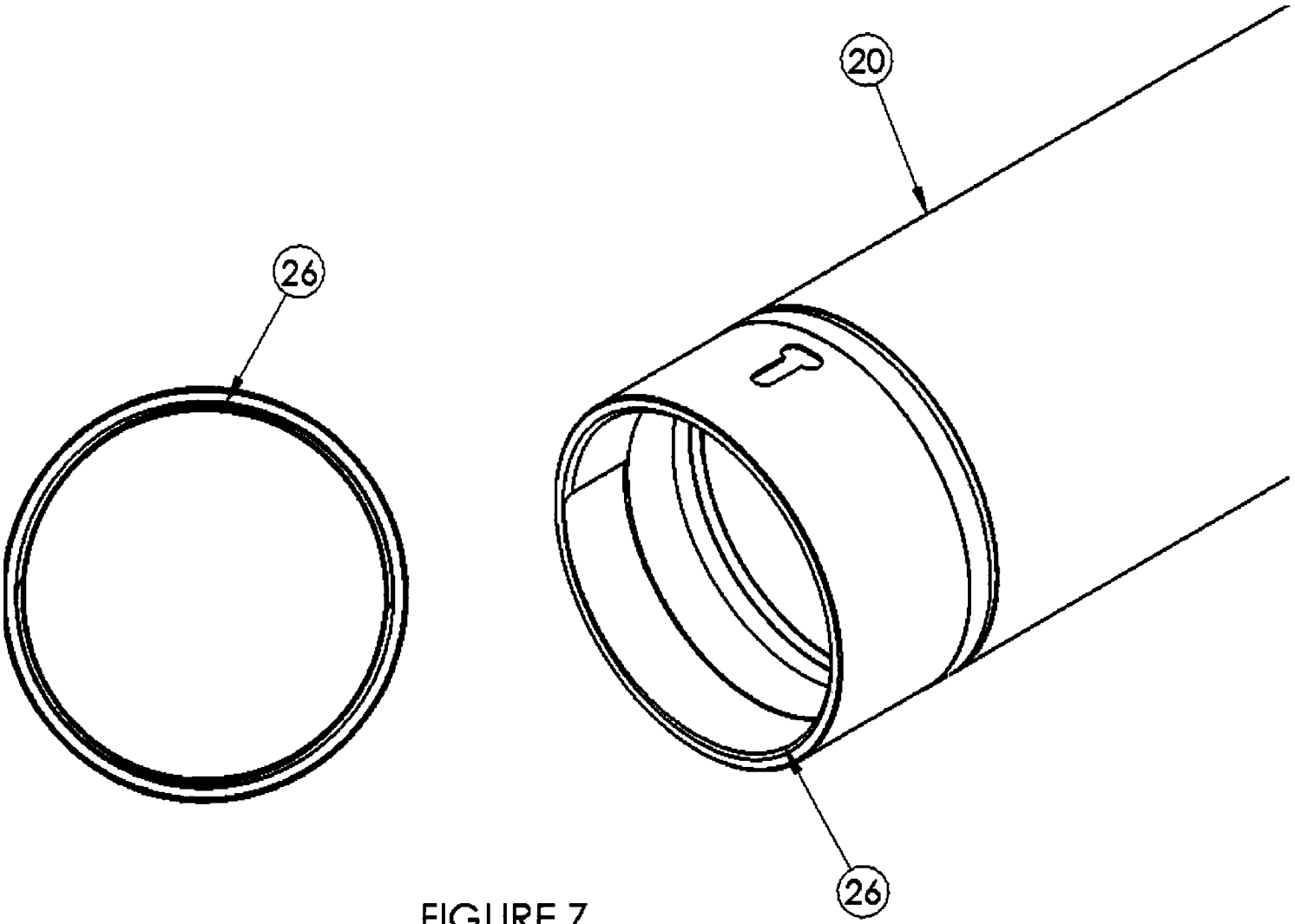
FIG. 7 shows an expanded view of a core end with an interior ratchet type geometric surface profile with two arcs in accordance with the present invention.
Figure 8:
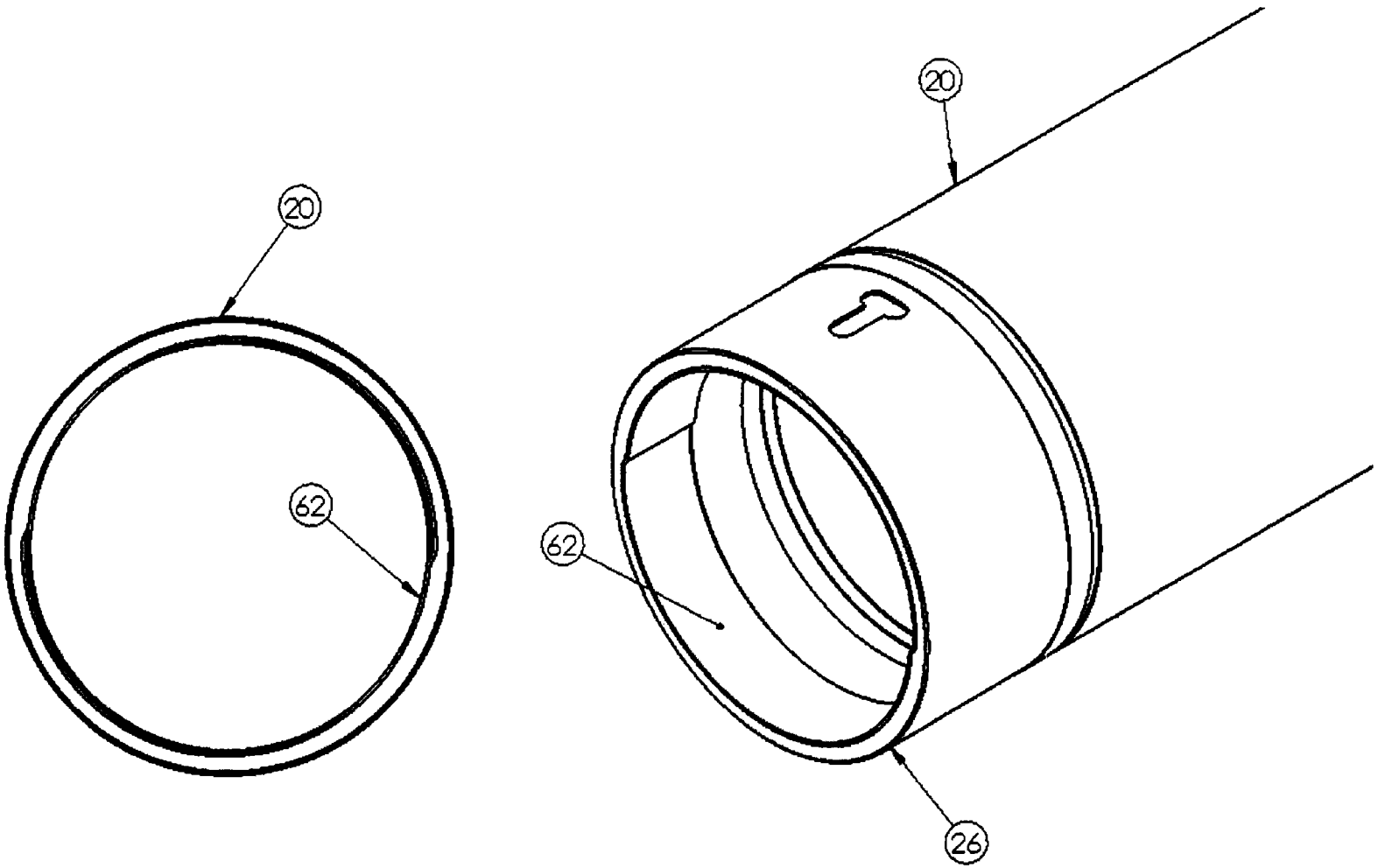
FIG. 8 shows and expanded view of a core end with an interior ratchet type geometric surface profile with two arcs and an elastomeric collar in accordance with the present invention.

FIG. 5 shows an expanded view of hub 50 having an exterior ratchet type geometric surface profile with two opposing arcs 52 and 54 in accordance with the present invention. Furthermore, FIG. 6 shows an expanded view of a hub having an exterior ratchet type geometric surface profile with two arcs and an elastomeric collar 60 in accordance with the present invention. FIG. 7 shows an expanded view of the corresponding mating interior surface of a fuser core end 26. Furthermore, FIG. 8 shows an expanded view of the corresponding mating interior surface of a fuser core end 26 having an interior ratchet type geometric surface profile with the addition of an elastomeric collar 62.

Figure 9:
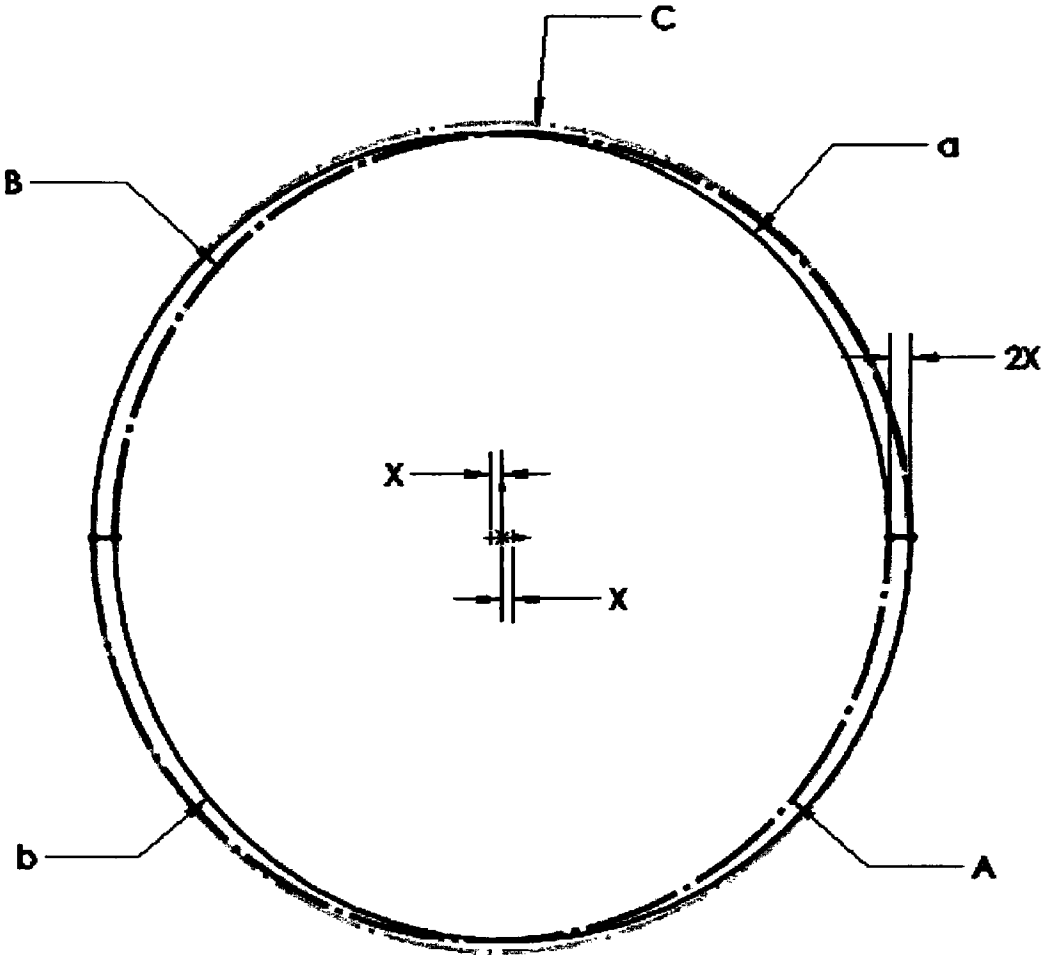
FIG. 9 shows a method from which the ratchet type geometric surface profiles may be generated in accordance with the present invention.

FIG. 9 shows the geometric arrangement of two opposing arcs. The ratchet type geometric profile is defined by at least two opposite circular arcs, 180 degrees apart, whereas a circle is defined as a subset of an ellipse. The arcs are defined by a curve which is a portion of a circle whereby the center of the circle is offset from a minor diameter circle. Each opposing arc is a portion of a circle whereby the center of the circle is offset equal but opposite distance along a straight line from the center of the minor circle. The distance from the center of the minor circle defines the height of the arc when the arcs are inscribed on an exterior surface of hub 50 or core 20. The distance from the center of the minor circle also defines the depth of the arc when the arcs are inscribed on an interior surface of hub 50 or core 20. As shown in FIG. 9, circle C is defined as the minor circle. The center of circle A is a distance x from the center of circle C and circle B is an equal distance x from the center of circle C, while the centers of circle A, circle B and circle C align along a straight line. Arc a and Arc b, formed by portions of the opposing circles, define the ratchet geometric type profile. The length of each arc a and the length of arc b are equal. The distance x between circle A and circle C, and the distance x between circle B and circle C define the height or the depth of the surface profile.

Figure 10:
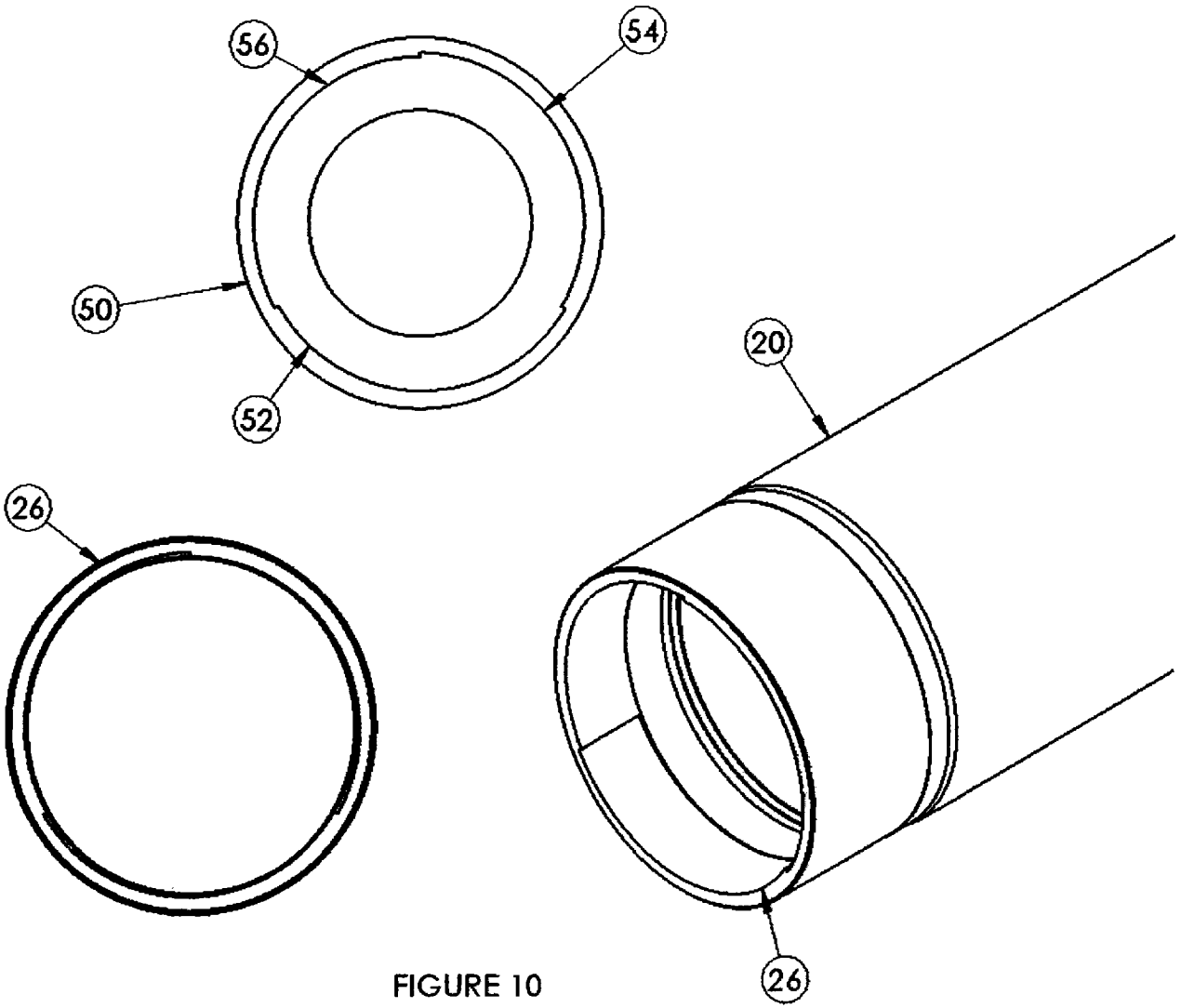
FIG. 10 shows an expanded isometric view of a hub and core end assembly with an exterior ratchet type geometric surface profile with more than two arcs in accordance with the present invention.

An alternative embodiment of the present invention is shown in FIG. 10, wherein hub 50 is shown having a ratchet type geometric surface profile having 3 arcs 52, 54, and 56. In an embodiment of the present invention, the ratchet type geometric surface profile may have 2, 3, 4, 5 or any integral number of arcs forming the surface profile. Correspondingly FIG. 10 also shows the mating interior of core end 26 having a mating interior ratchet type geometric surface profile having 3 arcs. Insertion of hub 50 disposed into mating fuser core end 26 and resulting rotation in the preferred direction forms a self locking drive mechanism.

Figure 11:
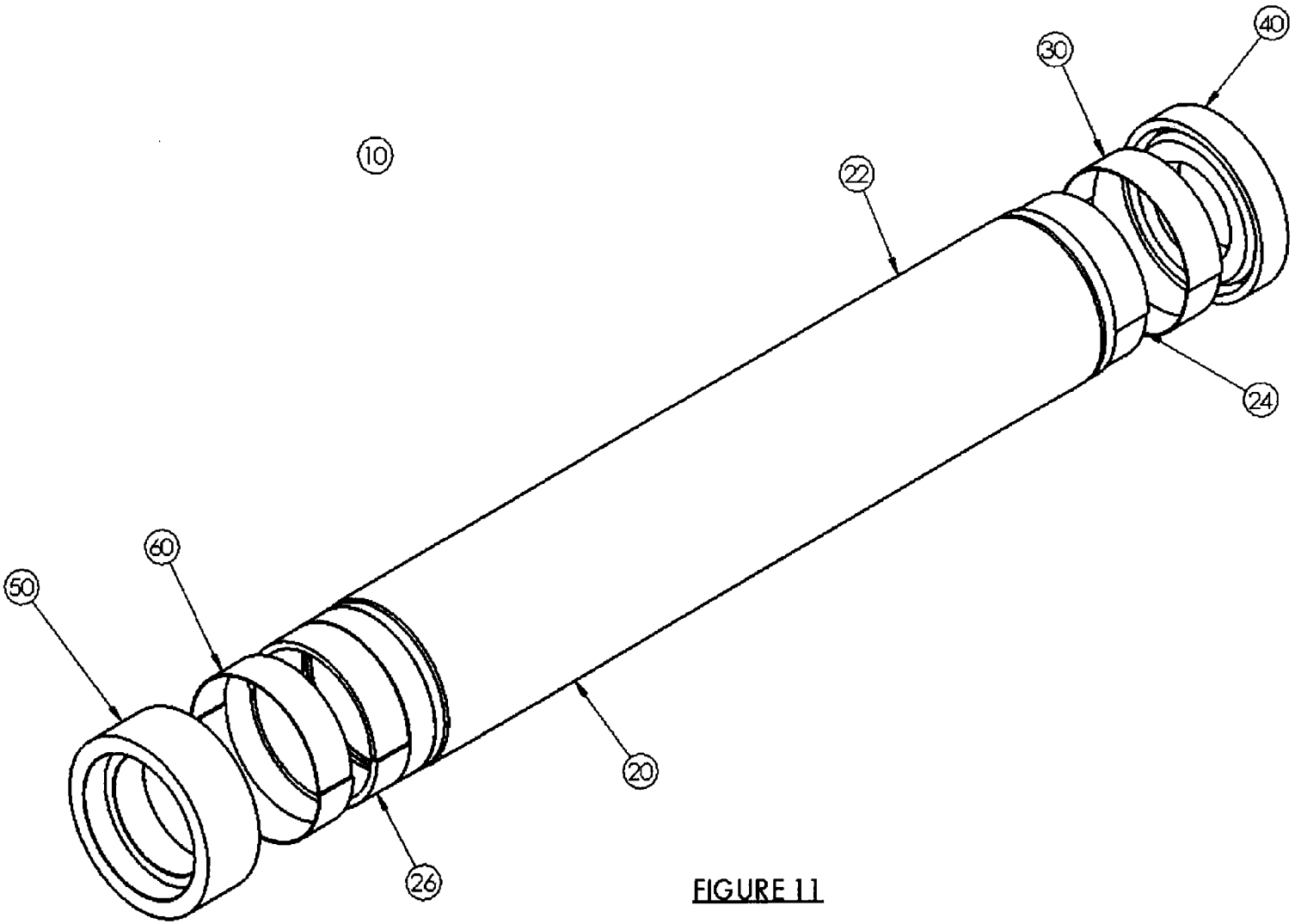
FIG. 11 shows an expanded isometric view of a hub and core with a hub having an interior ratchet type geometric surface profile and a core end having an exterior ratchet type geometric surface profile in accordance with the present invention.

FIG. 11 shows an alternative embodiment of the present invention wherein the ratchet type geometric surface profiles are reversed on the hubs and core ends. FIG. 11 shows an expanded isometric view of core 20 with an end 26 having an exterior ratchet type geometric surface profile and hub 50 having a mating interior ratchet type geometric surface profile. Furthermore FIG. 11 shows an expanded isometric view of core 20 with an end 26 having an exterior ratchet type geometric surface profile an elastomeric collar 60 and hub 50 having an interior ratchet type geometric surface profile. In an alternative embodiment of the present invention, fuser core end 26 having an exterior ratchet type geometric surface profile is inserted into hub 50 having a mating interior ratchet type geometric surface profile. Upon rotation of either component, the mechanism will tighten creating a drive mechanism in the preferred rotational direction of the fuser roller. Furthermore the addition of an elastomeric collar 60, as shown, will provide improved contact and stability at elevated operational temperatures of the fusing system as described in U.S. Pat. No. 7,242,899 B2, July 2007, Eichhorn et al.

In accordance with the present invention, collar 30 may be disposed onto hub 40. Similarly collar 60 may be disposed on hub 50. Collar 30 is configured to substantially eliminate or reduce the clearance between the outside diameter of hub 40 and the inside diameter of end 24. Similarly, collar 60 is configured to substantially eliminate or reduce the clearance between the outside diameter of hub 50 and the inside diameter of end 26.

Collars 30 and 60 are fabricated of an elastomeric material. The elastomeric material layer may comprise any thermosetting elastomer, thermoplastic elastomer, polymer alloy, blend or hybrid material capable of continuous operation at temperatures up to 482° F. (250° C.). Suitable examples of the elastomeric material include, but are not limited to, silicone materials, flurosilicone material, fluoro-carbon material or any copolymer, terpolymer, or blend of the fore mentioned materials.

In a preferred embodiment the elastomeric material has a low volume swell in the presence of functional and non functional polydimethlsiloxane fluids at the fuser's operating temperature. In an alternative embodiment, the elastomeric material for collars 30 and 60 comprises a fluorocarbon material (FKM) having a hardness between 40 and 95 Shore A.

Collars 30 and 60 may be independently molded and subsequently assembled onto hubs 40 and 50. Alternatively, collars 30 and 60 may be molded directly onto the hub members 40 and 50 using various bonding agents.

The FKM used for making collar 30 and collar 60 of the preferred embodiment expands in thickness about 0.004 inches (0.01016 cm) at the operating temperature of 400° F. (204° C.). The resultant diameter of the hub/collar assembly diameter at operating temperature is similar to the internal diameter of aluminum core 20 at end 24 and end 26. The resulting fit between the core 20 and the hub/collar assembly at operating temperature is optimal, i.e. not too tight or constrained and not too loose.

The present invention may be applied to a wide variety of printers and copiers, including devices manufactured by Ricoh Company, Ltd. of Tokyo, Japan; Canon Kabushiki Kaisha of Tokyo, Japan; Xerox Corporation of Stamford, Conn.; Kodak Corporation of Rochester, N.Y.; Oce Printing Systems, Venlo, Netherlands, as well as others proficient in the design and manufacturing of printers and copiers.

The invention having been disclosed in connection with the foregoing variations and examples, additional variations will now be apparent to persons skilled in the art. The invention is not intended to be limited to the variations specifically mentioned, and reference should be made to the drawings rather than the foregoing discussion of preferred examples, to assess the scope of the invention.

What is claimed is:

1. A system for stabilizing a fuser core in an imaging device comprising:

a fuser core having a body defined by an outside diameter, a first end, and a second end opposite the first end, wherein the first end is formed by a first cavity having a first ratchet type geometric profile about the surface of the first cavity, and wherein the second end is formed by a second cavity having a second ratchet type geometric profile about the surface of the second cavity;

a first hub having an end defined by an exterior surface, wherein the exterior surface includes a ratchet type geometric profile configured to mate with the first cavity, wherein the exterior surface of the first hub is at least partially disposed inside the first end; and a second hub having an end defined by an exterior surface, wherein the exterior surface includes a ratchet type geometric profile configured to mate with the second cavity; wherein the exterior surface of the second hub is at least partially disposed inside the second end, wherein the first ratchet type geometric profile is comprised by at least two opposite circular arcs, the arcs oriented 180 degrees apart, whereas a circle is defined as a subset of an ellipse, and the arcs are defined by a curve which is a portion of a circle whereby the center of the circle is offset from a minor diameter circle, and each opposing arc is a portion of a circle whereby the center of the circle is offset and equal but opposite distance along a straight line from the center of the minor circle, wherein the distance from the center of the minor circle defines a height or depth of the arc, depending upon if the arcs are inscribed on an exterior or interior surface.

2. The system of claim 1, wherein the ratchet type geometric profile is comprised by at least three circular arcs, wherein the corresponding opposing curves are offset, in degrees, around a minor circle, by divisive integral multiples, generated by 360 degrees divided by the number of arcs to be used.

3. The apparatus of claim 1, wherein the first and the second hub each has a body defined by an outside diameter, wherein the outside diameter of the body is the same as the outside diameter of the fuser core.

4. The apparatus of claim 1, further comprising:

a first elastomeric collar having a first inside diameter; and a second elastomeric collar having a second inside diameter, wherein the first inside diameter is at least partially disposed over the exterior surface of the first hub, and wherein the second inside diameter is at least partially disposed over the exterior surface of the second hub.

5. The apparatus of claim 4, wherein the first and second collars are fabricated from an elastomeric material selected from the group consisting of thermosetting elastomers, thermoplastic elastomers, polymer alloys, blends or hybrid materials capable of continuous operation at temperatures tip to 482.degree. F. (250.degree. C.).

6. The apparatus of claim 5, wherein a hardness of the elastomeric material is between 30 and 95 Shore A.

7. The apparatus of claim 4, wherein the first collar is molded onto the first hub and the second collar is molded onto the second hub.

8. The apparatus of claim 7, wherein the first collar is secured to the first hub using a chemical primer and the second collar is secured to the second hub using a chemical primer.

* * * * *